United States Patent [19]

Roberts

[11] 4,420,995

[45] Dec. 20, 1983

[54] QUICK-RELEASE AND POSITIVE LOCKING MECHANISM FOR USE ON SOCKET WRENCHES AND ON POWER AND IMPACT TOOLS

[76] Inventor: Peter M. Roberts, P.O. Box 15762, Red Bank, Tenn. 37415

[21] Appl. No.: 270,733

[22] Filed: Jun. 5, 1981

[51] Int. Cl.[3] ..... B25B 13/46

[52] U.S. Cl. ..... 81/60; 81/177 G; 81/463

[58] Field of Search ..... 81/62, 177 G, 463, 60–63.2

[56] References Cited

U.S. PATENT DOCUMENTS

| | | | |
|---|---|---|---|
| 2,008,367 | 7/1935 | Rhinevault | 81/177 G |
| 3,172,675 | 3/1965 | Gonzalez | 81/177 G |
| 3,208,318 | 9/1965 | Roberts | 81/177 G |
| 3,438,291 | 4/1969 | Bergquist | 81/62 |
| 3,532,013 | 10/1970 | Haznar | 81/177 G |
| 4,187,747 | 2/1980 | Pawlow | 81/177 G |
| 4,245,528 | 1/1981 | Hugh et al. | 81/177 G |
| 4,317,392 | 3/1982 | Stephens et al. | 81/177 G |

*Primary Examiner*—James L. Jones, Jr.

*Attorney, Agent, or Firm*—Willian, Brinks, Olds, Hofer, Gilson & Lione Ltd.

[57] ABSTRACT

A quick-release and positive locking mechanism, adaptable for use on tools for receiving removable tool sockets, particularly adaptable for use on socket wrenches or power or impact tools. A tool for receiving a removable tool attachment is disclosed, having a drive stud for receiving a removable tool attachment, a first means for normally engaging said tool attachment, a second means for normally selectively releasing said tool attachment, and a third means for positively locking said tool attachment to the drive stud.

13 Claims, 13 Drawing Figures

FIG. 5
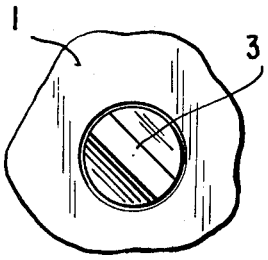
FIG. 6
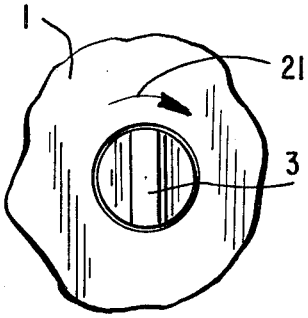
FIG. 7
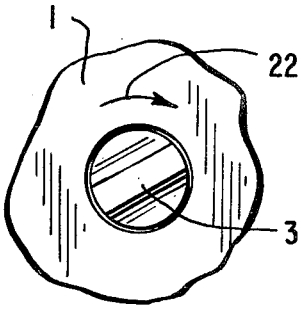
FIG. 8
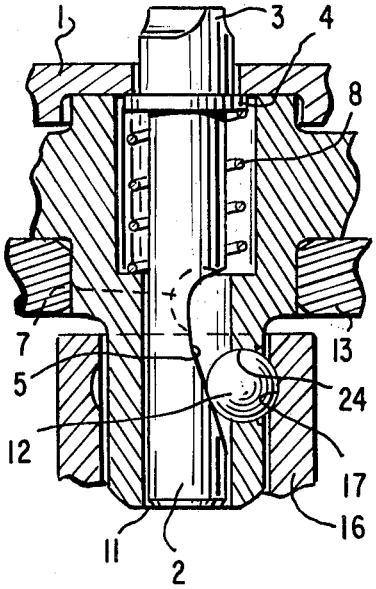
FIG. 9
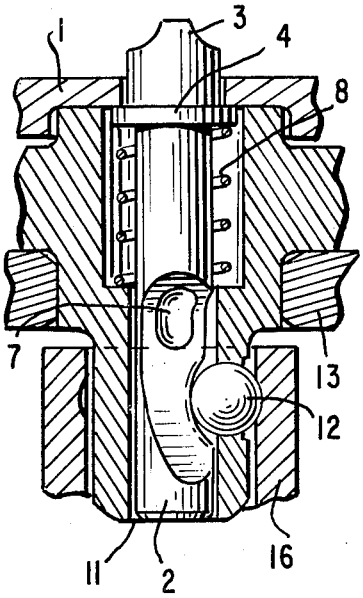
FIG. 10
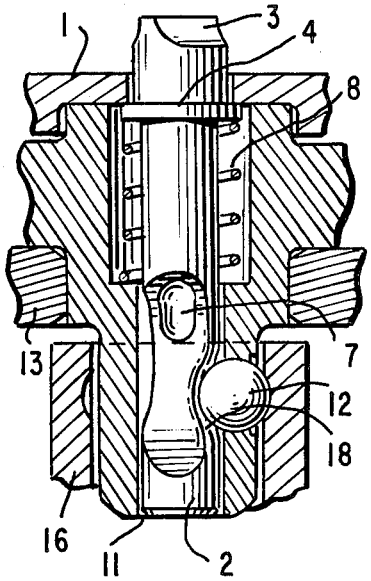
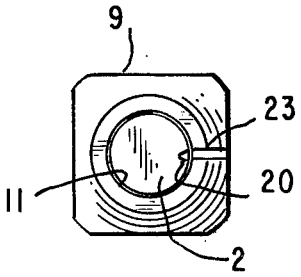
FIG. 11
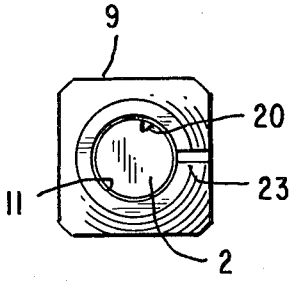
FIG. 12
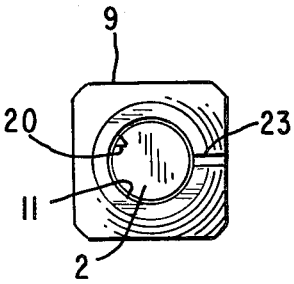
FIG. 13

QUICK-RELEASE AND POSITIVE LOCKING MECHANISM FOR USE ON SOCKET WRENCHES AND ON POWER AND IMPACT TOOLS

BACKGROUND OF THE INVENTION

It is the purpose of this invention to provide a mechanism for securely retaining sockets or other tool attachments on, and easily releasing them from, socket wrenches. The mechanism of this invention can generally be used on all hand-held tools, including power and impact tools having removable sockets or other tool attachments and in particular can be used with hand-held socket ratchet wrenches.

Socket wrenches of the type referred to herein have a handle, a head, and a square or hexagonal (or the like) drive stud or tang for receiving removable sockets or other tool attachments. For many years prior to the invention of the first quick-release mechanism for socket wrenches as disclosed in U.S. Pat. No. 3,208,318 (Roberts), the removable sockets were usually secured to the wrench with a conventional ball detent mechanism.

In the conventional ball detent design, the ball detent is spring mounted in an aperture in the drive stud with the normal position of the ball detent being in an outward position, that is, with the ball projecting outward of the surface of the drive stud. When the socket is mounted on the drive stud, the spring loaded detent protrudes from the exterior surface of the drive stud to engage a recess in the socket and thereby hold the socket onto the drive stud. To remove the socket from this conventional ball detent design stud, the user normally grasps the socket with his hand and exerts a force on it by pulling it, thereby forcing the spring loaded ball detent to recede into the aperture so that the socket can be pulled or pried off and released from the drive stud.

This conventional manner of securing and releasing sockets, however, resulted in a great many practical difficulties. One of these problems was that the removal of the socket required the use of both of the user's hands: one hand to hold the handle of the wrench and the other hand to pull the socket off the drive stud. Removal of the socket in this manner became a particularly time-consuming and labor wasting task, especially when the socket or the user's hands became greasy and it consequently became difficult for the user to grasp and hold the socket while pulling on it. This problem was exacerbated by the stiff spring necessarily present in a new wrench if the spring was to exert a force sufficient to retain a socket or other attachment through the expected life of the wrench.

Moreover, removal of this socket proved difficult or impossible if the conventional ball detent spring mechanism jammed, as it sometimes did when it became contaminated with dirt or grease, both of which are, of course, ordinarily present in the working places of mechanics who frequently use such tools. The consequence of such contamination was that a great deal of force was ordinarily required to remove the socket.

As a makeshift remedy for these problems, users frequently removed the socket from the wrench by prying it off with a screwdriver or other levering device. Indeed, the problem became so acute that some manufacturers offered special tools to pry off sockets. This time-consuming procedure of removing sockets from wrenches became particularly troublesome for commercial mechanics, who frequently use such wrenches for many hours during the day and change sockets many times during that period.

Prior to the instant invention, the first and only fully effective solution to this problem is provided in the "quick-release" mechanism shown in the above-referred to Roberts' patent. As shown in that patent (FIG. 1, 2, 3, 4), an elongate longitudinal passage in the drive stud receives an elongate slideable pin, one end extending through the top of the head of the wrench and secured to a control knob and the other end substantially flush during normal operation with the bottom face of the drive stud. The drive stud has an aperture for receiving a ball detent, the edges of the aperture preventing the ball detent from passing outside of the stud.

A coil spring mounted in a section of said longitudinal passage maintains the pin normally in a position to keep the ball detent in an outward position, the ball detent thereby normally engaging and securely holding the socket. The slideable elongate pin is provided with a recess, so that when the operating button is depressed, the pin moves longitudinally in the passage until the detent is received in the recess. At that point, the socket is no longer secured to the drive stud and can be permitted to drop off through the force of gravity.

The above-described invention proved to be a remarkable success that was quickly adopted in most conventional socket wrenches and virtually revolutionalized the socket wrench field. For the first time any user of socket wrenches could easily and swiftly remove sockets from socket wrenches and replace sockets back on the drive stud with little effort, and while using only one hand. One-handed operation was a decided time and cost advantage when, for example, a mechanic needed one hand to change a socket while holding a part he was working on in place with the other hand. Today, a large percentage of all socket wrenches in use are provided with some mechanism to facilitate the release of sockets from wrenches.

Roberts' quick-release mechanism, however, did not provide for positive locking of the socket onto the drive stud to prevent accidental release of the socket. This added feature would be highly useful on power and impact tools and also on socket wrenches when, for example, work is being done on bridges or high buildings or the like where the accidental loss of a socket by unintended release can also be very dangerous to valuable or delicate machinery or property below and even to life.

There are numerous other circumstances where a positive locking mechanism would be highly desirable. For example, in using socket wrenches in repetitive tasks requiring prolonged use of the same tool attachment, a positively locking mechanism is highly desirable. In another circumstance, it is sometimes necessary to employ what is referred to as an extension bar to facilitate the removal of bolts that would otherwise not be accessible to a mechanic. An extension bar is ordinarily secured to the drive stud of the wrench, as is any regular socket; the other end of the extension bar is provided with a similar drive stud for receiving a socket. Ordinarily, the socket is retained and released from the extension bar drive stud with a conventional ball detent mechanism of the kind described above.

When a user needs to remove a socket from the extension bar, he simply pulls it off. But in doing so, it is imperative that he not also remove the extension bar from the wrench drive stud which would often happen in a conventionally designed ball detent mechanism; to do so would be frustrating and time consuming, requiring a three-hand operation. The incorporation of a locking mechanism onto the socket wrench to securely lock the extension bar onto the drive stud alleviates this problem.

There is therefore a need in the field for an inexpensive, reliable, and easy to construct mechanism for socket wrenches that permits the rapid release and retention of sockets during normal, or "quick-release" operation, and also permits the user to positively lock the socket onto the drive stud of the wrench in a "positively locked" mode in order to preclude the possibility of accidental release of the socket.

OBJECTS AND SUMMARY OF THE INVENTION

It is an object of this invention to provide an inexpensive and easy to construct mechanism for retaining and releasing sockets from hand-held tools such as socket wrenches and power and impact tools.

It is a further object of this invention to provide a mechanism for retaining and releasing sockets from socket wrenches and power and impact tools, which mechanism also permits the user to positively lock the socket to the wrench, thus allowing the user to selectively eliminate the possibility of an accidental release of a socket from the wrench.

It is a still further object of the invention to provide a socket wrench or power or impact tool with the above features, which wrench is easy and inexpensive to construct and reliable and easy to use in normal operating conditions.

These and other objects of the present invention will become apparent from the following specification, accompanying drawings, and appended claims.

The present invention will be described as it is used on a usual hand-held socket ratchet wrench having a handle, a head, and a usually square or hexagonal drive stud attached thereto for receiving sockets or other similar tool attachments. In one embodiment of the invention, the drive stud has a longitudinal passage for receiving an elongate slidable and rotatable pin, and further has an aperture for receiving a ball detent. The edges of the aperture are of a lesser diameter than the ball detent, which edges prevent the ball detent from falling outside the drive stud.

One end of the slidable and rotatable elongate pin is connected to a control knob which extends through the head of the wrench for easy access by the user. When used in a quick-release mode, the ball detent rests on the surface of the pin so that it projects outward of the stud to engage a receiving recess in the socket. The pin is maintained normally in this position by force of one end of a coil spring on the underside of the control knob of the pin, the other end of said spring resting on a wall or ridge in an enlarged portion of said longitudinal passage. The socket, including one of varying tolerance, is thereby normally selectively aligned and securely held to the stud.

To release the socket when the wrench is in the quick-release mode, the user merely depresses the control knob thereby longitudinally moving the elongate pin in a direction towards the end of the drive stud holding the socket. The elongate pin is provided with a first recess for receiving the ball during this movement and this first recess is of such a depth, that, when the ball is received therein, it no longer engages the recess in the socket and the socket is thereby released. At this point, the socket can be taken off by hand or simply be permitted to drop off through force of gravity.

In one specific embodiment, said first recess has a ramped or cammed surface, the ball detent normally in contact with said cammed surface, so that when the socket is pulled from the wrench in a conventional manner without depressing the control knob, force is transferred to the ball detent, which in turn forces the pin in the longitudinal direction towards the end of the drive stud holding the socket until the detent enters the recess and the socket is released. Thus, an additional feature in one specific embodiment of the invention is that even without depressing the operating button, the socket can be pulled off the drive stud in the conventional manner.

In one embodiment, the elongate pin is also equipped with a second recess somewhat more shallow in depth and narrower (as measured in the longitudinal direction of the elongate pin) than the first. In said embodiment, the second recess is, in angular position, and may be approximately between 90° and 180° from the first recess. The two recesses are joined by a connecting passage that permits the ball detent to travel from the first recess to the second recess when the elongate pin is rotated. As will be apparent from an inspection of the drawings this passage may be provided by locating the first and second recesses so that their peripheries in effect overlap whereby the resulting space between the two recesses constitutes a passage through which the detent passes when moving form one recess to the other. Also, if desired, a structurally separate passage could be provided in cases where overlapping recesses are not employed-for instance in cases where the recesses are separated by more than 90°. It is desirable, in some instances, to provide a longitudinal component of travel for the detent relative to the pin, in the direction of the axis of the pin, so that the spring acting on the pin tends to hold the detent in locked position.

The user of the socket wrench of the invention, when working on a high building, or over machinery, may decide only to use the device in the positively locked mode. To do this, he grasps the control knob and rotates it, thereby rotating the pin in the drive stud. The control knob is designed, shaped and finished in a manner to facilitate this grasping and turning operation.

As the pin is turned in a direction which would ultimately place the ball detent in the second recess, the ball detent first encounters the connecting passage. As the pin is further turned, the ball detent continues to travel through the passage until it is fully seated in the second recess. This second recess is of such depth that the ball detent is held in an outward position to positively lock the socket in place. Said second recess is of such width as to snugly hold the ball detent in the recess without permitting further longitudinal movement of the pin. Thus, the locked position locks not only the ball detent but the longitudinal pin as well. The feel of the locked wrench is thus transmitted directly to the user, since the control knob cannot be depressed. In this positively locked mode, the socket cannot be released by depressing the control knob and the possibility of accidental release and loss of the socket or other tool attachment is effectively eliminated.

In one embodiment, the connecting passage in the pin may be constructed such that the ball detent, as it travels in the passage from the first recess to the second recess, has a longitudinal component of travel parallel to the longitudinal axis of the pin, said direction being towards the end of the stud holding the tool attachment. When the ball detent rests in the second recess in the positively locked position, the consequence of this specially shaped passage is that as vibration is imparted to the tool while in use, the longitudinal pressure of the spring on the pin will have a continual self-tightening effect in the positively locked mode.

DESCRIPTION OF THE DRAWINGS

FIGS. 5, 6 and 7 are top plan views of the control knob of the quick-release and positive locking mechanism of the invention as the control knob is rotated.

FIGS. 8, 9 and 10 are partial sectional views of the quick-release and positive locking mechanism of the invention as the elongate slidable and rotatable pin is rotated as shown in a hand-held socket wrench.

FIGS. 11, 12 and 13 are bottom plan views of the elongate slidable and rotatable pin of the quick-release and positive locking mechanism of the invention as the pin is rotated.

DESCRIPTION OF EMBODIMENTS OF THE INVENTION

Figure 4:
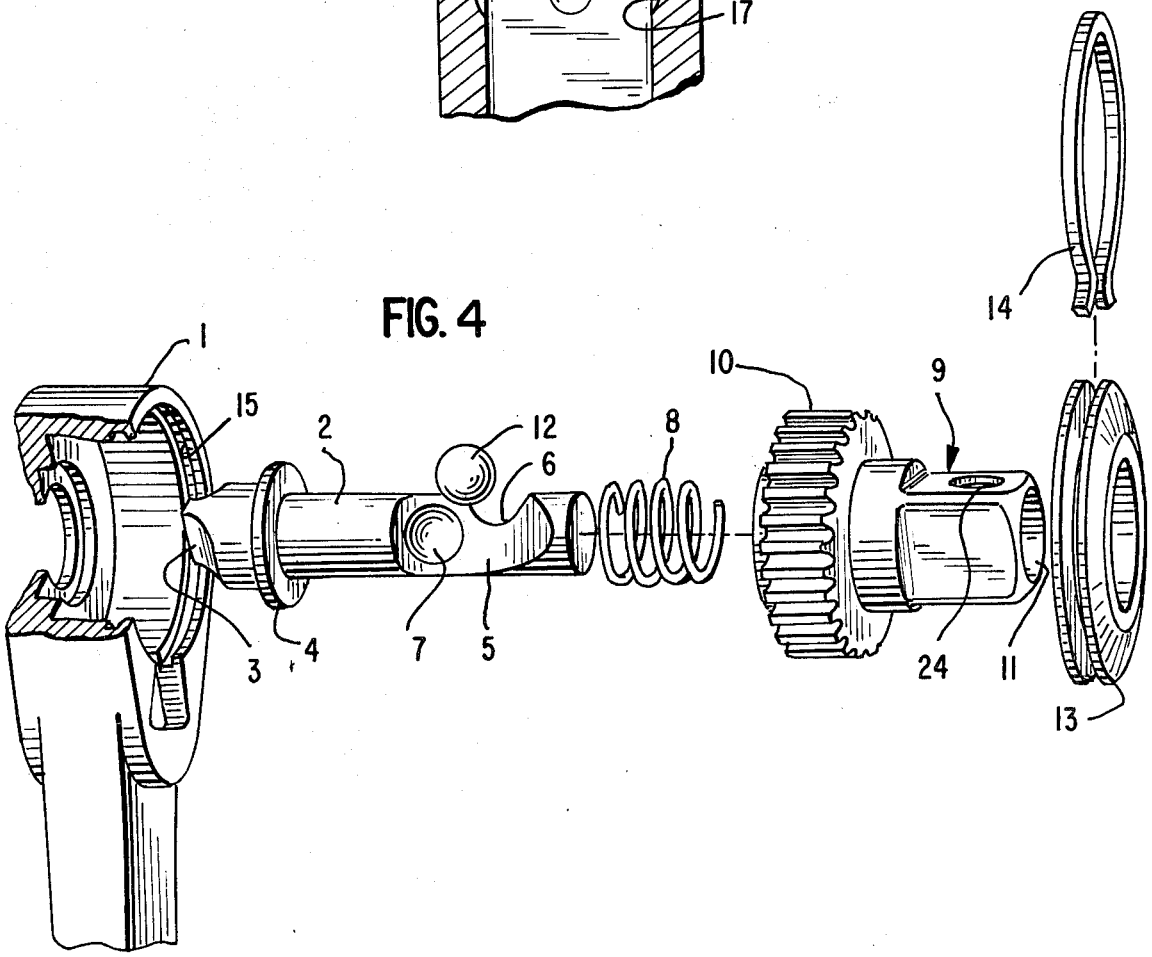
FIG. 4 is an exploded side perspective view of the quick-release and positive locking mechanism of the invention so shown.

FIG. 4 is an exploded perspective view of the socket wrench of the invention as it is assembled. The interior of the head 1 of the wrench is shown as it would receive in assembly the other elements of the apparatus of the invention. The elongate slidable and rotatable pin is shown 2, comprising at one end a control knob 3 and a retention ring 4. The elongate pin further comprises a first recess 5, a passage 6 leading to a second recess (not shown on FIG. 4), and an assembly recess 7. After assembly, one end of the coil spring 8 abuts against the retention ring 4 and the other end abuts against a wall or ridge (not shown) in the longitudinal passage in the drive stud 9. Incorporated into the drive stud 9 is a ratchet gear mechanism 10.

Continuing to refer to FIG. 4, in assembly, the ball detent 12 is placed in the special assembly recess 7, which is of such depth that the ball detent, when seated in said recess, essentially does not project beyond the cylindrical elongate surface of the elongate pin. The coil spring surrounds the pin and abuts against the retention ring 4. The whole pin assembly is inserted into the drive stud, the insertion of the ball detent into the assembly recess permitting said pin 2 and ball detent 12 to clear the longitudinal passage in the drive stud; when inserted, the mechanism can be oriented so that the ball detent 12 drops from the assembly recess 7 to recess 5. During operation of the wrench thereafter, the ball detent 12 does not enter the assembly recess 7, but remains in recess 5.

The entire pin and drive stud assembly is secured to the head 1 of the wrench by any conventional means. In this preferred embodiment it is secured to the head of the wrench with a ring 13 and releasable spring 14 which fits into a groove 15 cut into the head of the wrench.

In this specific embodiment of the invention, the portion of the drive stud 9 receiving the socket itself is square, with chamfered corners, and the aperture 24 for receiving the ball detent 12 is shown on one face of said drive stud. In this particular embodiment, the square face of the drive stud at the socket end has a circular opening 11, permitting the elongate pin 2 to extend therefrom, and also permitting the circular face of the elongate pin to be viewed by the user.

Figure 1:
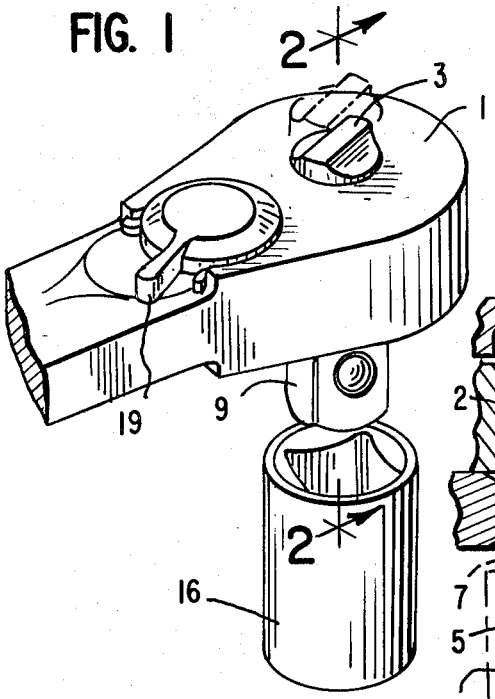
FIG. 1 is a partial perspective view of the head of a wrench embodying the quick-release and positive locking mechanism of the invention as it is releasing a socket.

FIG. 1 shows a perspective view of the wrench as a socket 16 is being released from the drive stud 9 when the wrench is in the quick-release mode. The control knob 3 is shown in solid lines in the depressed position, as it would appear when releasing a socket 16. The control knob 3 is also shown in dotted lines in its normal position retaining the socket. A ratchet reversing lever 19 is shown as it is conventionally mounted on ratchet wrenches.

Figure 2:
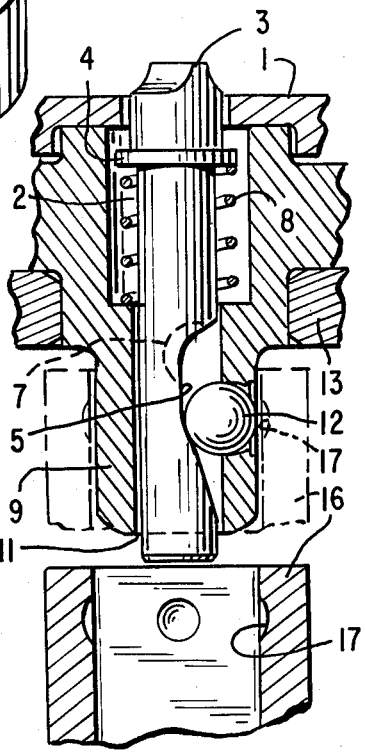
FIG. 2 is a partial cross sectional view of the quick release and positive locking mechanism of the invention as shown in a hand-held socket wrench.
Figure 3:
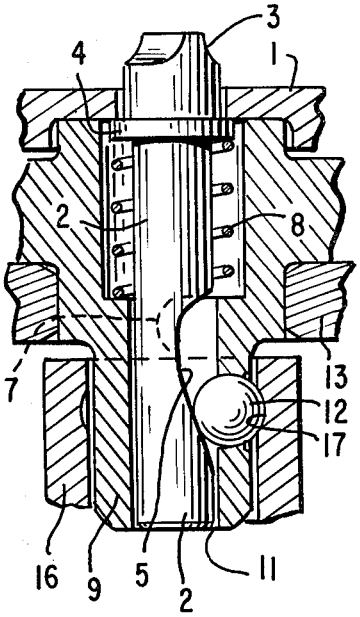
FIG. 3 is a partial cross sectional view of the quick-release and positive locking mechanism of the invention so shown.

FIGS. 2 and 3 show a sectional view of the mechanism of the invention as it would be used in the quick-release mode. In FIG. 3, socket 16 is shown held onto the drive stud with the ball detent 12. This is accomplished by the engagement of the ball detent 12 with a recess 17 in the socket 16. The position of the ball detent 12 is maintained by contact with the surface of the elongate slidable and rotatable pin 2. In the specific embodiment shown, the ball detent is in contact with a cammed or ramped surface, which permits the socket to be removed without depressing the control knob. As shown, elongate pin 2 is maintained in a longitudinal position to normally affect such contact by force of the coil spring 8 on the underside of the retaining ring 4.

In FIG. 2, the socket 16 is shown as it is released from the drive stud. The control knob 3 is shown in a depressed position, and the entire elongate pin assembly is shown to have moved in a direction towards the end of the drive stud that receives the socket. As shown, this operation, of course, further compresses the coil spring 8. The elongate pin 2 extends outside the circular opening 11 in the square face of the drive stud in the specific embodiment shown. The ball detent has retracted deeper into recess 5, no longer engages recess 17 in the socket 16, and the socket 16 is free to drop away from the drive stud 9.

FIGS. 5 to 13 inclusive show the apparatus of the invention as the elongate pin 2 is rotated and the mechanism is thereby converted from the quick-release mode to the positively locked mode. FIGS. 5, 6 and 7 show the relative angular position of the control knob 3 during said rotation. FIGS. 8, 9 and 10 show a partial sectional view of the quick-release and positive locking mechanism of the invention during said rotation, and FIGS. 11, 12 and 13 show bottom plan views of the elongate pin 2 during rotation.

FIG. 5 shows the control knob 3 in the position it would be in when the positive locking mechanism is not engaged. In FIG. 8, the ball detent 12 is shown to be outwardly projected from the aperture 24 to securely hold the socket 16. FIG. 11 shows the circular face of the pin at the end nearest the socket having an indicator mark 20 with an indicator mark 23 on the square face of the stud to show the relative angular position of the pin.

The indicator marks 20, 23 may simply comprise a notch cut directly in the metal surface of the pin and stud. In another embodiment, said indicator marks may be made with bright or fluorescent or other highly visible paint or the like. The purpose of the marks is to show a user the relative angular position of the pin and, thus facilitate verification as to whether the apparatus of the invention is in a positively locked mode or a quick-release mode.

In FIGS. 6, 9 and 12, the elongate pin 2 has been rotated in the direction shown 21 in FIG. 6 approximately 45° from the FIGS. 5, 8 and 11 position. In FIG. 9, the ball detent 12 is shown in the connecting passage 6, and the indicator mark 20 on the bottom face of the elongate pin, as shown in FIG. 12 indicates a 45° rotation in bottom plan view.

In FIGS. 7, 10 and 13, the control knob has been rotated about 45° from the position shown in FIGS. 6, 9 and 12 in the direction shown 22, fully converting the wrench from the quick-release to the positively locked mode. The ball detent 12 is shown in the second recess 18, said second recess being shallower in depth than the first recess, and also being narrower (as measured in the longitudinal direction of the elongate pin) than said first recess. The second recess is of such depth that the ball detent 12 is maintained in an outward position to securely engage the recess 17 in the socket 16, and is of such width that the elongate pin cannot be substantially moved in the longitudinal direction. Thus, when the socket wrench is in the positively locked mode as shown in FIG. 6, the socket cannot be released by accidentally depressing the control knob 3 or by pulling on the socket.

When the user desires to convert the socket wrench from the positively locked mode back to the quick-release mode, it should be understood that the above rotation is simply reversed, the ball detent thereby being transferred from the second recess 18 to the first recess 5 by way of the connecting passage 6.

The apparatus of the present invention has been described in respect to one particular embodiment. It will be understood to those skilled in the art that modifications can be made in said apparatus according to the invention without exceeding the ambit of its spirit and scope.

In the appended claims the term "tool attachment" is intended to include sockets for turning bolts or the like and extension bars adapted to receive at their outer ends sockets for turning bolts or the like as well as other tools which can be similarly attached to and operated by the drive stud of a wrench.

Furthermore the language of the claims defining the attaching and releasing mechanism and the locking mechanism is intended to apply to such mechanisms when embodied in tools containing a stud for driving sockets and the like, whether manually or power driven.

What is claimed is:

1. In a tool for receiving a removable tool attachment, a handle, a head mounted thereon, a drive stud secured to the head of the tool for receiving said removable tool attachment, said drive stud having a longitudinal passage for receiving an elongate slidable and rotatable pin, said drive stud further having an aperture for receiving a ball detent, said aperture securing the ball detent to the drive stud, said ball detent being normally in contact with the surface of the pin so that the detent extends outward of the drive stud and engages a recess in said tool attachment to securely hold said tool attachment to the drive stud, said elongate pin having two recesses and a passage between said recesses, a first recess for receiving the ball detent by selective longitudinal alignment of the pin, in which first recess the ball detent retracts thereby releasing the tool attachment, and a second recess for receiving the ball detent by selective rotation of the pin such that during rotation the ball detent travels from the first recess through said passage between the recesses to the second recess, the depth of said second recess being such that the ball detent is maintained in an outward position, and the width of said second recess being such that the tool attachment is securely locked to the drive stud essentially precluding substantial movement of the ball detent.

2. In a tool for receiving a removable tool attachment, a handle, a head mounted thereon, a drive stud secured to the head of the tool for receiving said removable tool attachment, said drive stud having a longitudinal passage for receiving an elongate slideable and rotatable pin, said drive stud further having an aperture for receiving a ball detent, said aperture securing the ball detent to drive stud, said ball detent being normally in contact with the surface of the pin so that the detent extends outward of the drive stud and engages a recess in said tool attachment to securely hold said tool attachment to the drive stud, said elongate pin having two recesses and a passage between said recesses, a first recess for holding the ball detent outward by selective longitudinal alignment of the pin and into which first recess the ball detent retracts thereby to release the tool attachment, and a second recess for receiving the ball detent by rotation of the pin such that during rotation the ball detent travels from the first recess through said passage between the recesses to the second recess, the depth of said second recess being such that the ball detent is maintained in an outward position and the tool attachment is securely locked to the drive stud.

3. The tool of claim 1 or 2, wherein said first and second recesses are located approximately between 90° and 180° apart in relative angular position.

4. The tool of claim 1, or 2 further characterized in that a spring is provided urging the pin in the direction away from said stud and in that said passage in said pin has a longitudinal component essentially parallel to the axis of the pin, whereby said spring tends to hold the detent in locking position.

5. In a tool for receiving a removable tool attachment, a handle, a head mounted thereon, a drive stud secured to the head of the tool for receiving said removable tool attachment, said drive stud having a longitudinal passage therein and an elongate pin slideably and rotatably mounted in said passage, said drive stud further having an aperture and a ball detent mounted in said aperture, said aperture securing the ball detent to the drive stud, said ball detent being in contact with the surface of said pin so that the detent normally extends outward of the drive stud and engages a recess in said tool attachment to securely hold said tool attachment to the drive stud, said elongate pin having two structurally distinct and communicating recesses the noncommunicating extremities of which are circumferentially displaced from one another on said pin, the first of said recesses serving to hold the ball detent outward by selective longitudinal alignment of the pin and into a portion of which first recess the ball detent retracts, thereby to release the tool attachment, and the second of said recess serving to receive the ball detent by rotation of the pin such that during such rotation the ball detent travels from the first recess to the second recess, the depth of said second recess being such that the ball detent is maintained in an outward position and the tool attachment is securely locked to the drive stud.

6. The tool of claim 5 wherein the noncommunicating extremities of said first and second recesses are located approximately between 90° and 180° apart in relative angular position.

7. The tool of claim 5 further characterized in that a spring is provided urging the pin in the direction away from said stud and in that said second recess in said pin has a longitudinal component essentially parallel to the axis of the pin, whereby said spring tends to hold the detent in locking position.

8. The tool of claim 1 or 5, said elongate pin having two ends, one end secured to a control knob to facilitate manual movement of said pin.

9. The tool of claim 1, 2 or 5, one end of said elongate pin having a bottom circular face visible to the user during use of said wrench, said bottom face provided with an indicator mark on the surface thereof to indicate the relative angular position of said elongate pin.

10. The tool of claim 1, 2 or 5 wherein said first recess is cammed with respect to the surface of said recess normally in contact with the ball detent whereby removal of the tool attachment from the drive stud is effected by impressing a longitudinal force on the tool attachment essentially along the axis of the drive stud in a direction opposite the head of the tool, said force resulting in the retraction of the ball detent and thereby the release of the tool attachment.

11. The tool of claim 1, 2 or 5, wherein the locking position essentially prevents longitudinal movement of said pin.

12. A tool for receiving a removable tool attachment, comprising a handle, a head mounted on said handle, a drive stud secured to said head for receiving a removable tool attachment, said drive stud having a longitudinal passage, therein, a pin mounted in said passage one end of which extends beyond said head to provide a control knob, said drive stud further having an aperture communicating with said passage and a detent mounted in said aperture, said detent being so disposed as to have contact with the surface of said pin so that the detent may extend outward of the drive stud to engage a recess in said tool attachment thereby securely to hold said tool attachment to the drive stud, said pin being capable of movement in said passage so that in the operation of said tool, movement of said pin may be made to effect contact between said detent and either one of two recesses in said pin, the noncommunicating extremities of which are circumferentially displaced from one another, and a spring urging said pin in one direction of movement, the first recess constituting a cam which is capable of causing the detent to move selectively inward and outward in response to a first movement of said pin by manipulation of said control knob whereby to effect the quick release of tool attachments from and attachment of tool attachments to said drive stud and the second recess by a second movement of said pin by manipulation of said control knob to positively lock said control knob against said first movement of said pin to thereby lock said detent in its outermost position in said aperture whereby a tool attachment mounted on said drive stud may be positively locked thereon against unintended removal therefrom.

13. The tool of claim 12 further characterize in that said cam is constructed and disposed to cause the pin yieldingly to move in response to inward movement of said detent by external pressure applied to said detent whereby to permit the forceful introduction of a tool attachment onto, and the forceful removal of a tool attachment from, said drive stud.

* * * * *